United States Patent [19]

Inukai et al.

[11] Patent Number: 5,026,030

[45] Date of Patent: Jun. 25, 1991

[54] MELTING AND HOLDING FURNACE

[75] Inventors: Masayuki Inukai; Masao Yamaoka, both of Yao, Japan

[73] Assignee: Kabushiki Kaisha Daiki Aluminum Kogyosho, Osaka, Japan

[21] Appl. No.: 414,350

[22] Filed: Sep. 29, 1989

[30] Foreign Application Priority Data

Sep. 30, 1988 [JP] Japan ..... 63-248861

[51] Int. Cl.[5] ..... F27B 3/04

[52] U.S. Cl. ..... 266/229; 266/242; 266/900; 266/901

[58] Field of Search ..... 266/242, 900, 901, 229, 266/230; 75/65 R, 68 R

[56] References Cited

U.S. PATENT DOCUMENTS

| | | | |
|---|---|---|---|
| 3,809,378 | 5/1974 | Iida | 266/901 |
| 4,691,900 | 9/1987 | Maeda | 266/901 |
| 4,850,577 | 7/1989 | Yamaoka | 266/242 |

*Primary Examiner*—Melvyn J. Andrews

*Attorney, Agent, or Firm*—Edwin E. Greigg; Ronald E. Greigg

[57] ABSTRACT

A melting and holding furnace comprising a preheating and melting chamber defining a preheating tower section in an upper position and a melting section in a lower position, a holding chamber communicating with the melting chamber, and a well communicating with the holding chamber. A melting burner is provided for jetting out flames obliquely downwardly into the melting section.

3 Claims, 3 Drawing Sheets

MELTING AND HOLDING FURNACE

BACKGROUND OF THE INVENTION (1) Field of the Invention

The present invention relates to an improvement in a melting and holding furnace for processing aluminum and other metals.

(2) Description of the Prior Art

A known melting and holding furnace will be described with reference to FIGS. 5 and 6 of the accompanying drawings. In the melting and holding furnace A', a raw material of aluminum is fed from a material preheating tower 20' to a melting chamber 21' continuous with the tower for heating and melting the material. Molten aluminum is then transferred to a holding chamber 8' communicating with the melting chamber 21', where the molten aluminum is heated by a sustaining burner 9' to be maintained at a selected temperature. The molten aluminum is removed little by little, for casting, from a well 5' communicating with the holding chamber 8'.

With such a known melting and holding furnace A' used for melting aluminum, the well 5' cannot be integrated with, the melting and holding furnace A' since the material preheating tower 20' and melting chamber 21' are provided separately. There is thus the disadvantage of a large overall configuration requiring a large installation space.

The melting chamber 21' includes a melting burner 4' which is a gas burner directed horizontally for producing, in elongated forms and with a weak jetting force, red reducing flames having a large infrared content. This prior construction has a disadvantage (1) of low operating efficiency. The material fed is little oxidized because of the reducing flames, but the flames sweep and melt only the faces of the material opposed to the flame jets, with its rear faces of the material being out of reach of the flames. This leaves a large unmolten amount of material at the side remote from the flames. The operator must open a door 22' to the material preheating tower 20' to shove the unmolten material down into the melting chamber 21'. There is also a disadvantage (2) of low thermal efficiency. Because the melting burner 4' has a weak flame jetting force and because the melting burner 4' is directed horizontally, hot air flows contacting the material to be preheated produce little turbulence in the melting chamber 21' and just ascend, gently without effectively preheating the material. Further, there is a disadvantage (3) of poor operating efficiency in that the weak flame jetting force results in a slow melting speed, and the long time taken for melting the material in turn results in low thermal efficiency.

The components of the known furnace are labeled with the same numbers as are used for corresponding components of the furnace of the present invention, with primes affixed thereto for distinction.

SUMMARY OF THE INVENTION

The present invention has been made having regard to the foregoing disadvantages of the prior art, and its object is to provide a novel melting and holding furnace which is compact and requires a reduced installation space, and which realizes improved operating efficiency and thermal efficiency.

In order to achieve the above object, a melting and holding furnace according to the present invention comprises a preheating and melting chamber defining a material inlet, a preheating tower section in an upper position for holding and preheating material supplied thereinto, and a melting section in a lower position for melting the preheated material, a holding chamber communicating with the melting chamber for receiving the molten metal from the melting section and maintaining the molten metal at a selected temperature, a well communicating with the holding chamber for receiving the molten metal and allowing the molten metal to be scooped out, and a melting burner mounted on a lower side wall of the preheating tower section for jetting out flames from a lower position of the preheating tower section obliquely downwardly into the melting section.

With the above construction, a material to be melted is first fed through the material inlet to fill the preheating tower section and melting section. Then, hot and strong reducing flames jet out of the melting burner obliquely downwardly toward the material. The flames reach the deep end of the melting section in a manner to envelope entire peripheries of the material in the melting section, thereby melting the material from the bottom at high speed. The melt thus formed in the melting section is at a low temperature just above the melting point, which flows into the holding chamber. The melt is heated to a selected temperature by a sustaining burner in the holding chamber. The low temperature melt flows zigzag along submerged banks, if they are provided, while being heated in the holding chamber, and finally flows into the well. Meanwhile, deposits precipitate along the submerged banks, and occluded gas is released, whereby the melt becomes stabilized before entry into the well. The stabilized melt is scooped little by little out of the well for use in casting. On the other hand, the flames having contacted the material become hot air flows tending to ascend the melting section. However, the strong flames jetting out obliquely downwardly obstruct ascent of the hot gas flows, thereby to produce strong turbulence in the melting section. Subsequently, the hot gas flows ascend the preheating tower section to preheat the material fed thereto.

As described above, the melting and holding furnace according to the present invention comprises a preheating and melting chamber defining a material inlet, a preheating tower section in an upper position for holding and preheating material supplied thereinto, and a melting section in a lower position for melting the preheated material. This preheating and holding chamber is compact compared with the separate preheating tower and melting chamber as in the known melting and holding furnace. Consequently, the well too may be installed on the same base block and the entire furnace requires about two thirds of the installation area for the known melting and holding furnace.

Since the melting burner is mounted on a lower side wall of the preheating tower section for jetting out flames from a lower position of the preheating tower section obliquely downwardly into the melting section, the hot and strong reducing flames jetting out of the melting burner reach the deep end of the melting section in a manner to envelope entire peripheries of the material to be molten, thereby melting the material in the melting section at high speed. Further, since the strong flames jet out obliquely downwardly toward the melting section, these flames obstruct ascent of the hot gas flows in the melting section, thereby to produce strong turbulence in the melting section for promoting high-speed melting of the material. The hot gas flows from the melting section ascend the preheating tower section as agitated under the influence of the turbulence in the melting section, with increased chances of contact with the material to be molten thereby to produce a great preheating effect. These features realize great advantages in promoting the thermal efficiency and melting speed as well as operating efficiency.

Other advantages of the present invention will be apparent from the following description.

BRIEF DESCRIPTION OF THE DRAWINGS

The drawings illustrate a melting and holding furnace embodying the present invention, in which.

DETAILED DESCRIPTION OF THE PREFERRED EMBODIMENT

Figure 1:
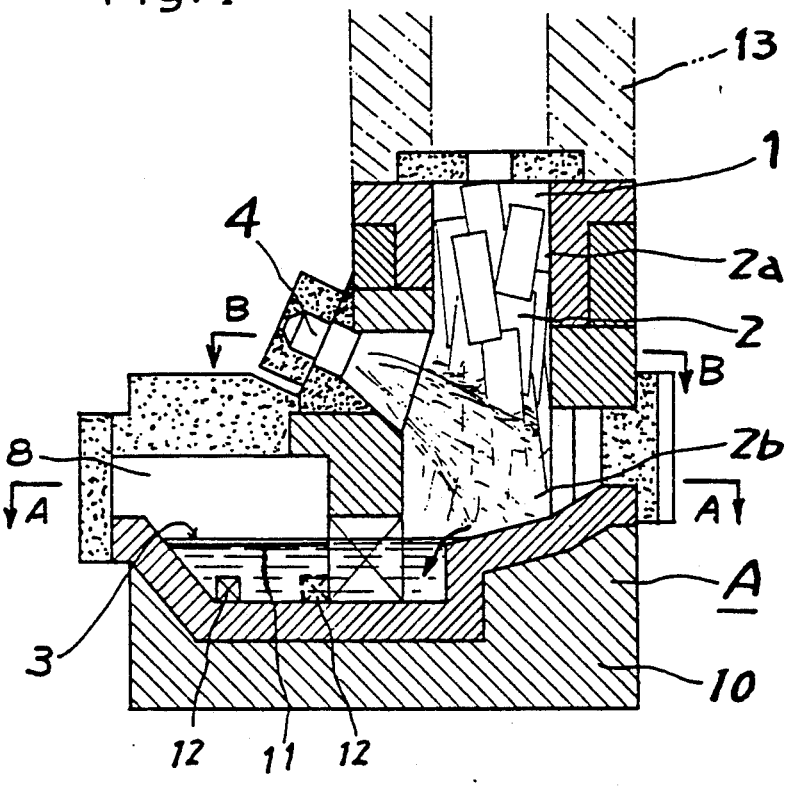
FIG. 1 is a sectional view of the melting and holding furnace.
Figure 2:
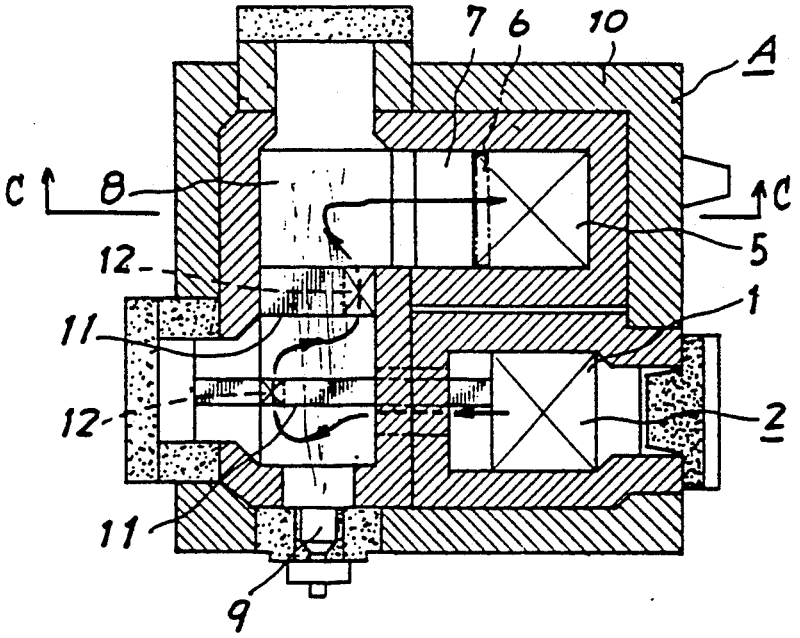
FIG. 2 is a section taken on line A—A of FIG. 1.
Figure 3:
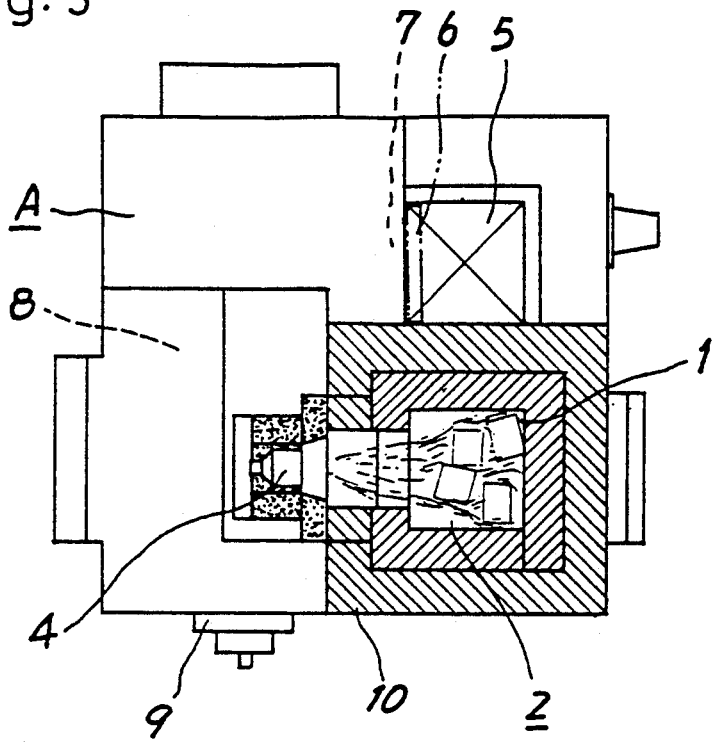
FIG. 3 is a section taken on line B—B of FIG. 1.

An embodiment of the present invention will be described hereinafter with reference to the drawings. A melting and holding furnace A comprises a preheating and melting chamber 2 defining a material inlet 1, a preheating tower section 2*a* in an upper position for holding and preheating material supplied thereinto, and a melting section 2*b* in a lower position for melting the preheated material. The furnace A further comprises a holding chamber 8 communicating with the melting chamber, 2 for receiving the molten metal from the melting section 2*b* and maintaining it at a selected temperature, and a well 5 communicating with the holding chamber 8 for receiving the molten metal and allowing it to be scooped out. To describe their positional relations more particularly, as seen from FIG. 2, the preheating tower section 2*a* and melting section 2*b* are vertically integrated, with the preheating tower section 2*a* located above and the melting section 2*b* located below. The preheating tower section 2*a* is open at the top as at 1 defining the material inlet 1, and a cassette tower section 13 may be added thereto from above, as necessary, as shown in phantom lines.

A melting burner 4 is mounted on a lower side wall of the preheating tower section 2*a* for jetting out flames from a lower position of the preheating tower section 2*a* obliquely downwardly into the melting section 2*b*. This melting burner 4 comprises, for example, a high luminous flame burner for producing short and strong reducing flames. The position of the side wall at which the melting burner 4 is installed opens inwardly in a slightly flared way. The bottom of the melting section 2*b* is inclined downwardly toward the holding chamber 8 for allowing the molten metal to flow naturally into the holding chamber 8. The holding chamber 8 has a bottom at a lower level than the bottom of the melting chamber 2 and, in this embodiment, elongated in a direction substantially perpendicular to the direction of influx from the melting section 2*b*. In this embodiment, the holding chamber 8 includes submerged banks projecting from the bottom and extending transversely of the holding chamber 8. The submerged banks 11 define staggered flow openings 12.

The holding chamber 8 includes a sustaining burner 9 for producing long red reducing flames having a large infrared content and jetting out from a molten metal inlet end toward an outlet end of the holding chamber 8. The flames sweep over the surface of melt 3 in the holding chamber 8 to maintain the melt 3 at a selected temperature.

Figure 4:
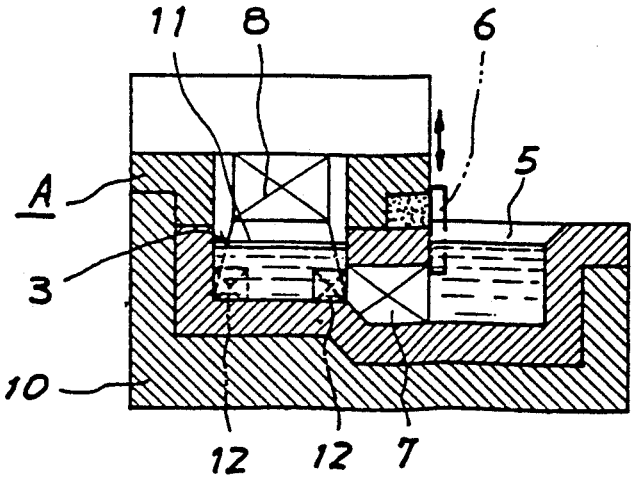
FIG. 4 is a section taken on line C—C of FIG. 1.
Figure 5:
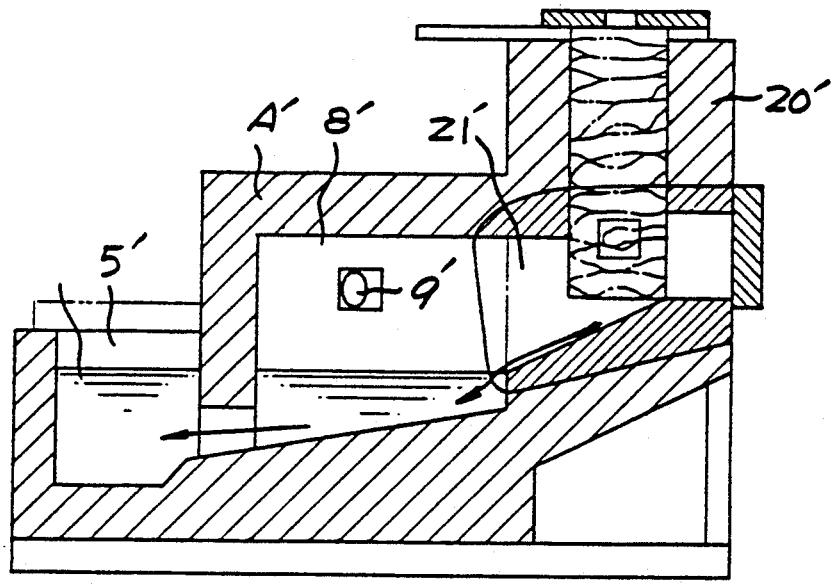
(Prior Art) Fig. 5
FIG. 5 is a view in vertical section of a known melting and holding furnace.
Figure 6:
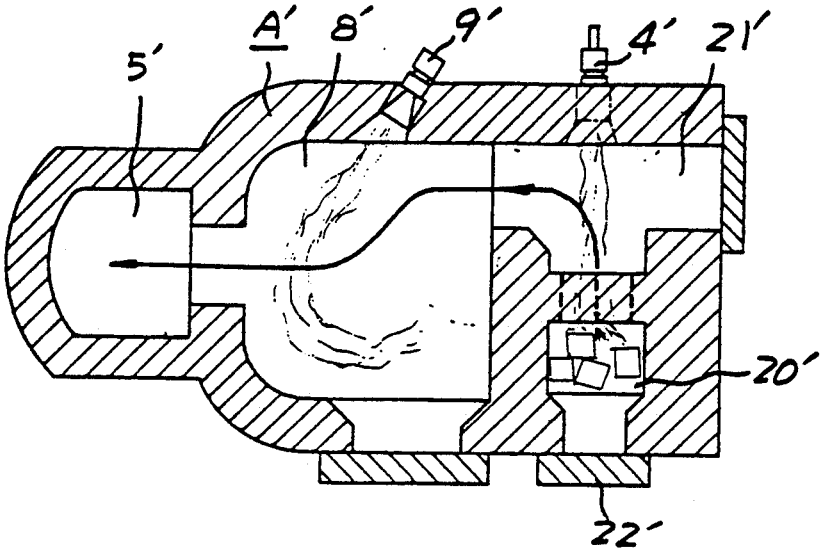
(Prior Art) Fig. 6
FIG. 6 is a sectional plan view of the known furnace.

A communicating opening 7 is defined in a downstream side wall of the holding chamber 8 to communicate with the well 5. Thus the well 5 is disposed substantially at right angles to the holding chamber 8. The preheating and melting chamber 2, holding chamber 8 and well 5 are provided on the same base 10 of the melting and holding furnace A to realize a very compact construction. The communicating opening 7 from the holding chamber 8 to the well 5 may be defined in a bottom position of the partition wall to be lower than the melt surface as shown in FIG. 4, or may be opened to a higher position than the melt surface as shown in a phantom line, with a skim damper 6 vertically movable according to an operating state. The well 5 includes a device for detecting the level of melt 3 and a temperature sensor to control the surface level and temperature of the melt 3, thereby to ensure quality control for a subsequent process.

The material to be molten usually is, but not limited to, a die cast metal such as aluminum, zinc or copper. An operation will be described hereinafter, taking aluminum melting for example. Of course, the operation is not limited to melting of aluminum. The sustaining burner 8 directs long reducing flames having a large infrared content into the holding chamber 8, so that the flames sweep over the melt 3 in the holding chamber 8 to maintain the melt 3 at the selected temperature. On the other hand, aluminum raw material is fed through the material inlet 1 into the preheating tower section 2*a* at appropriate times as the melt 3 is scooped out, and is preheated by hot gas flows ascending the preheating tower section 2*a*. The material fed to be molten fills the preheating tower section 2*a* and melting section 2*b*, and the hot and strong reducing flames jetting out of the melting burner 4 reach the deep end of the melting section 2*b* in a manner to envelope entire peripheries of the material to be molten, thereby melting the material in the melting section 2*b* at high speed. Since the strong flames jet out obliquely downwardly toward the melting section 2*b*, these flames obstruct ascent of the hot gas flows in the melting section 2*b*, thereby to produce strong turbulence in the melting section 2*b* for promoting high-speed melting of the material. The hot gas flows from the melting section 2*b* ascend the preheating tower section 2*a* as agitated under the influence of the turbulence in the melting section 2*b*, with increased chances of contact with the material to be molten thereby to produce a great preheating effect.

Aluminum thus molten flows down the melting section 2*b* into the holding chamber 8, flows zigzag along the submerged banks 11, and finally into the well 5. The melt 3 immediately after its formation, whether through direct contact with the flames or through immersion, occludes a large amount of gas such as hydrogen gas. Such occluded gas is released during a long residence time of the melt flowing zigzag in the holding chamber 8, whereby the melt 3 becomes stabilized before entry into the well 5. Further, the melt 3 immediately after its formation is at a low temperature just above the melting point, which produces deposits of iron, silicon and so forth on the bottom of the holding chamber 8. However, these deposits are prevented by the submerged banks 11 from flowing into the well 5. Further, the low-temperature melt 3 immediately after its formation flows zigzag along the banks 11 instead of flowing straight into the well 5, whereby the melt is heated to the selected temperature. Thus, there is no lowering of the melt temperature in the well 5.

The melt in the holding chamber 8 has the less weight because of the presence of the submerged banks 11, which results in a reduced area for exposure to the heat. The submerged banks 11 of course are not absolutely necessary, but may be provided as appropriate.

COMPARATIVE EXAMPLE

The performance of the melting and holding furnace A according to the present invention was compared with that of the known melting and holding furnace A' by using a cold material. The results are shown in the following table:

| Starting from cold material | Known Furnace | Furnace of this Invention |
|---|---|---|
| melting time | 4.75 H | 4.25 H |
| temp. rise time | 0.5 H | 0.5 H |
| gas consumption | 305,100 kcal/5.25 H | 260,500 kcal/4.25 H |
| | 11.3 $m^3$ | 9.65 $m^3$ |
| thermal efficiency | 20.3% | 23.7% |

The above results prove that the melting and holding furnace according to the present invention has a high-speed melting performance and produces an outstanding energy-saving effect.

Since integration is made down to the well 5, the entire furnace is very compact and requires two thirds of the installation area for the known melting and holding furnace A'.

What is claimed is:

1. A melting and holding furnace for raw material comprising:

a base (10), a melting chamber (2) including a preheating tower section 2*a*, a holding chamber (8), and a well (5) disposed on said base (10), said preheating tower (2*a*) having a material inlet (1) at a top portion thereof disposed above said melting chamber and having a longitudinal axis, said melting chamber (2) includes a bottom, a melting burner is disposed at a base portion of the preheating tower on a lower side wall of the preheating tower for jetting out flames of the melting burner obliquely downwardly relative to the longitudinal axis of the preheating tower toward the melting chamber, said holding chamber being adjacent the melting chamber and including an inlet for communicating therewith to receive a molten metal from an outlet of the melting chamber, said holding chamber having a bottom at a lower level than said bottom of said melting chamber, a sustaining burner positioned in an upper area of said holding chamber to direct a flame from said inlet end of said holding chamber which receives a molten metal from said outlet of said melting chamber toward an outlet end of said holding chamber for sustaining the molten metal in the holding chamber at a temperature sufficient to sustain a molten metal, and said well is disposed adjacent the holding chamber to receive the molten metal from said outlet end of said holding chamber.

2. A melting and holding furnace as claimed in claim 1, further comprising a vertically movable skim damper disposed between said holding chamber and said well.

3. A melting and holding chamber as claimed in claim 1, in which said bottom of said melting chamber is formed as a downwardly sloping bottom surface.

* * * * *